United States Patent [19]

Marshall

[11] 4,043,142

[45] Aug. 23, 1977

[54] DAMPENING ROLL COVER

[75] Inventor: Preston F. Marshall, Walpole, Mass.

[73] Assignee: The Kendall Company, Boston, Mass.

[21] Appl. No.: 552,514

[22] Filed: Feb. 24, 1975

[51] Int. Cl.[2] ..... D04B 1/00

[52] U.S. Cl. ..... 66/170

[58] Field of Search ..... 66/169, 20, 170, 171, 66/190, 191; 57/140, 7, 152, 163; 29/131

[56] References Cited

U.S. PATENT DOCUMENTS

| | | | |
|---|---|---|---|
| 1,577,752 | 3/1926 | Price | 66/190 X |
| 1,864,345 | 6/1932 | Fox | 66/190 |
| 2,017,444 | 10/1935 | Page | 60/190 X |
| 2,035,384 | 3/1936 | Hinchliff | 66/170 |
| 3,041,812 | 7/1962 | Marshall | 57/6 |
| 3,043,088 | 7/1962 | Breen | 57/140 |
| 3,078,653 | 2/1963 | Marshall | 57/152 |
| 3,078,654 | 2/1963 | Marshall | 57/163 |
| 3,082,591 | 3/1963 | Marshall | 57/6 |
| 3,180,115 | 4/1965 | Marshall | 66/170 |
| Re. 25,046 | 10/1961 | Knohl | 66/20 X |

*Primary Examiner*—Ronald Feldbaum
*Attorney, Agent, or Firm*—Edward J. Scahill, Jr.

[57] ABSTRACT

An elastic dampening roll cover knitted in the form of a tubular sleeve comprising knitted courses and wales of inelastic absorbent yarn, with an elastic yarn interlaced with the courses and wales around the circumference of the tubular sleeve, said inelastic absorbent yarn comprising a substantially inelastic air-bulked yarn having a plurality of substantially continuous filaments which are individually convoluted into coils, crunodal loops and whorls at random intervals along their length and the surface of said yarn having a plurality of crunodal loops irregularly spaced therealong, said elastic yarn comprising an elastic core strand and a wrapping strand associated with the elastic core strand in the form of doubled-back loops wound with false twist for a multiplicity of turns around the circumference of the elastic core strand.

1 Claim, 4 Drawing Figures

DAMPENING ROLL COVER

BACKGROUND OF THE INVENTION

This invention relates to dampening roll covers for use in lithographic press rolls, and more particularly it relates to knitted dampening roll covers which are composed of elastic yarns and bulked filament yarns to provide a close fitting seamless cover which does not wrinkle, does not have to be adhesively secured to the core and does not leave the pattern of the cover in the printed copy.

It has been known in the art to provide dampening roll covers of knapped flannel, of the type known as molleton, in the form of sewn tubular sleeves as well as in the form of a spiral wrap of slit flannel adhesively secured to the roll surface. It has also been proposed to provide dampening roll covers of a plain tubular knit construction, or terrycloth construction, in sleeve form. Although such knitted sleeves may possess some stretch, they are not, in general, truly form fitting, and must be manufactured to such close tolerances that their application to a rubber dampening roll becomes a major effort, involving the use of slip-sheets of acetate film to serve as a friction reducing layer between the rubber and the knitted sleeve. Removal is somewhat laborious, since prior art sleeves must be cut from the roll, with the danger of damage to the underlying rubber surface. Additionally, since prior art sleeves have no elastic recovery they must be anchored on the roll, which is customarily done by means of draw strings in either end of the sleeve or cover.

In my earlier U.S. Pat. No. 3,180,115, it was found that by the incorporation into a dampening roll sleeve of elastic yarns, by which was meant true rubber yarns, spandex yarns, and similar elastomeric yarns with essentially complete and immediate recovery from deformation within elongations of from 10% to 300%, a superior tubular dampening roll sleeve is provided which eliminates many of the disadvantages inherent in prior art covers. The dampening roll cover of that invention was superior to prior art covers in a number of respects but suffered from a major drawback -- it frequently produced a pattern in the printed copy. The wrapped yarn used therein as the inelastic surface yarn provided an essentially compact central element with protruding loops that radiated from that central element of the yarn, but these loops made very little contribution to the bulk and softness of the central yarn core element that formed the knitting stitch. Accordingly, the knitting stitch was not deformed by the pressure of nip into a smooth surface, but maintained, rather, because of its relatively incompressible nature, a surface pattern that showed the shape of the stitch and transmitted this non-uniformity in the form of a pattern of moisture onto the surface of the plate, thereby producing a pattern in the printed copy.

Accordingly, it is an object of this invention to provide a dampening roll cover for use in lithographic press rolls which has all the advantages of the elastic, knitted dampening roll cover described above but does not suffer from the major drawback therein of leaving a pattern in the printed copy produced thereby.

It is another object of this invention to provide a form fitting elastic dampening roll cover comprising elastomeric yarns together with a bulked filament yarn which will have the bulk and softness that will be deformed by the nip pressure so as to produce a more evenly formed surface therein that will reduce patterns in the printed copy.

Other objects of the invention will be apparent from the description below and from the example contained therein.

SUMMARY OF THE INVENTION

A bulked filament yarn and an elastic wrapped yarn are used to make an elastic dampening roll cover knitted in the form of a tubular sleeve that substantially eliminates pattern produced in the printed copy. The dampening roll cover comprises knitted courses and wales of inelastic absorbent yarn with an elastic yarn interlaced with said courses and wales around the circumference of the tubular sleeve, said inelastic absorbent yarn comprising a substantially inelastic bulked yarn having a plurality of substantially continuous filaments which are individually convoluted into coils, crunodal loops and whorls at random intervals along their length and the surface of said yarn having a plurality of crunodal loops irregularly spaced therealong, said elastic yarn comprising an elastic core strand and a wrapping strand associated with said elastic core strand in the form of doubled-back loops wound with fals twist for a multiplicity of turns around the circumference of the elastic core strand.

DETAILED DESCRIPTION OF THE PREFERRED EMBODIMENTS

It has been found that dampening roll covers, such as are described in my U.S. Pat. No. 3,180,115 of common assignee, have improved the art of elastic dampening roll covers but suffer from a drawback in that these covers leave an undersirable pattern in the printed copy. The wrapped yarn used therein as the inelastic surface yarn provided an essentially compact central element with protruding loops that radiated from that central element of the yarn but made very little contribution to the bulk and softness of the central yarn core element that formed the knitting stitch. Accordingly, it has been found that the knitting stitch was not deformed by the pressure of nip into a smooth surface but, instead maintained a surface pattern that revealed the shape of the stitch and transmitted this non-uniformity in the form of a pattern of moisture onto the surface of the plate.

It has now been found, however, that by replacing this corewrapped inelastic yarn with a bulked filament yarn, wherein the bulking resides along the axis of the yarn, the entire bulk of the yarn, because it is soft, it deformed by the nip pressure thereby producing a more evenly formed surface that reduces or eliminates pattern in the printed copy.

Figure 1:
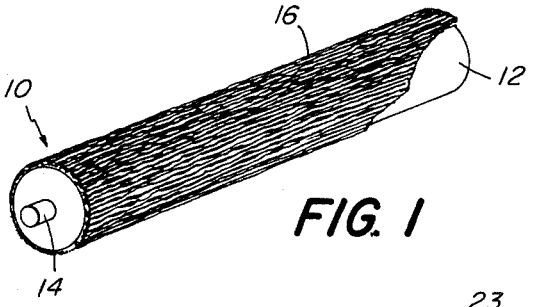
FIG. 1 is a perspective view of a dampening roll having a cover made in acordance with this invention.

With reference to the drawings, FIG. 1 shows a perspective view, partly broken away, of a lithographic dampening roll 10 consisting of a rubber cover roll 12 with a mandrel 14 and a dampening roll cover 16 of this invention. The covering 16 can be made of a combination of elastic yarns and bulked filament yarns as described herein. In my earlier U.S. Pat. No. 3,078,653, it has been described how to prepare an elastic, wrapped yarn wherein the peculiarly disposed arrangement of the wrapping strand loops, extending radially from the core strand, facilitates yarn-to-yarn interlocking. It has now been discovered that smooth surface dampening roll covers are produced when such yarns are fashioned into woven or knitted structures together with bulked filament yarns.

Figure 2:
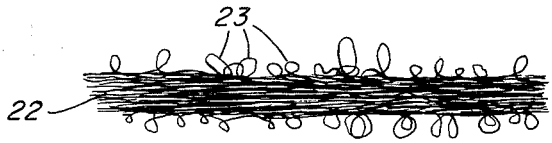
FIG. 2 is an enlarged view of the inelastic bulked yarn used to make the dampening roll cover of this invention.

A bulked filament yarn, such as is described in U.S. Pat. No. 2,783,609, is composed of a plurality of substantially continuous, individially convoluted filaments and can preferably be used to make the dampening roll cover of this invention. FIG. 2 of the drawings show such a yarn wherein the substantially continuous filaments 22 are individually convoluted into coils, crunodal loops and whorls, such as shown at 23, at random intervals along the length of the filaments 22. The yarn surface being characterized by a multiplicity of ring-like loops irregularly spaced therealong. These air-bulked filament yarns have been found to advantageously combine with the wrapped elastic yarn to produce a durable, form fitting and smoothly efficient dampening roll cover that is deformed by the nip pressure so as to produce a more evenly formed surface that reduces pattern in the lithographed copy.

Figure 3:
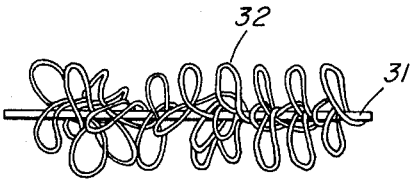
FIG. 3 is an enlarged view of the wrapped elastic yarn used in this invention; and, FIG. 4 is an enlarged view of the fabric cover of an embodiment of this invention.

FIG. 3 of the drawings shows an enlarged view of a portion of the elastic wrapped yarn used in this invention. Such an elastic wrapped yarn can be made as described in U.S. Pat. No. 3,078,653, wherein a multiplicity of doubled-back ends form loops 32 wound with false twist from a multiplicity of turns around the circumference of the core. The loops generally perpendicular to the radially from a tensioned central elastic core strand 31 from the central axis of the yarn and outwardly there beyond. In the so wound and twisted wrapping strand, the individually looped strand portions may be partially entangled, snarled, and interlocked with adjacent loops and/or the crunodal loops on the bulked filament yarn as to completely resist unwinding. Dampening roll covers made in accordance with this invention have exceptionally long lives and, because of the softness of the inelastic absorbent yarn of this invention, they will not leave any pattern in the printed copy obtained therewith.

This invention can perhaps be described more clearly by way of the following examples:

EXAMPLE I

A dampening roll for an Addressograph-Multigraph machine, Model No. 1250, was made on a 72 needle circular knitting machine with approximately 5 needles per inch. The machine was run using two knitting feed stations and two lay-in stations. the two knitting feed stations were each furnished with one end of an air-bulked filament yarn and each lay-in station was furnished with two ends of yarn, thus giving a total of six ends of yarn being fed into the machine. The knitting feed stations were each furnished with one end of approximately 3,000-denier bulked filament yarn consisting of two ends of an air-bulked filament yarn composed of a core consisting of two ends of 200-denier 32-filament nylon (such as type 6 6), and an effect yarn consisting of three ends of 300-denier 60-filament rayon. This gave an air-bulked yarn a composition of 18% nylon and 82% rayon in the total 3,000-denier air-bulked yarn. The two in-laid yarns furnished to each lay-in station were identical and consisted of a 37's rubber count elastic rubber core wrapped with a 150-denier 40-filament white viscose rayon yarn to a total denier of 5,843. The wrapping was carried out according to the process described in U.S. Pat. No. 3,078,654. The rounds per linear inch of finished relaxed fabric ran from 9 to 11. The length of yarn in each knitting round measured about 36 inches, and the length of the relaxed interlaced yarn per round ran about 4.5 inches. The circumference of the knitted tube measured about 5.85 inches and the tube weighed approximately 4.37 grams per running inch.

Figure 4:
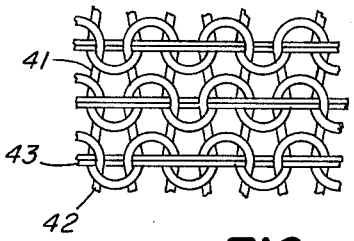

FIG. 4 of the drawings shows, in enlarged detail, such a structure wherein the loops 41 of the one ended air-bulked yarn 42 are shown inlaid with two ends of the wrapped elastic core yarn 43.

EXAMPLE II

A dampening roll cover for an Addressograph-Multigraph machine, Model No. 1250, was similarly made on a 72 needle circular knitting machine with approximately 5 needles per inch. The machine was run using two knitting feed stations and two lay-in stations. The two knitting feed stations were each furnished with one end of an air-bulked yarn and each lay-in station was furnished with two ends of yarn as outlined in Example I, thus giving a total of six ends of yarn being fed into the machine. The knitting feed stations were each furnished with one end of 2,380-denier bulked filament yarn consisting of two ends of an air-bulked filament yarn composed of a core consisting of two end of 200-denier 32-filament nylon, and an effect yarn consisting of three ends of 300-denier 60-filament rayon. This gave the air-bulked yarn a composition of 22.7% nylon and 77.3% rayon in the total 2,380-denier air-bulked yarn. The two in-laid yarns furnished to each lay-in station were identical and consisted of a 37's rubber count elastic rubber core wrapped with a 150-denier 40-filament white viscose rayon yarn to a total denier of 5,843. The wrapping was again carried out according to the process described in U.S. Pat. No. 3,078,654. The rounds per linear inch of finished relaxed fabric ran from about 9 to 11. The length of yarn in each knitting round measured about 36 inches and the length of the relaxed interlaced yarn per round ran about 4.5 inches. The circumference of the knitted tube measured about 5.85 inches and the tube weighted approximately 3.78 grams per running inch.

This fabric has the same structure as is shown in FIG. 4 discussed above.

Although it has been described herein that an air-bulked filament yarn, such as is described in U.S. Pat. No. 2,783,609, is preferred as the inelastic yarn, similar, although somewhat less desirable, results can be obtained with other bulked filament yarns. For example, course chenille-type textured yarns, upholstery type bulked yarns and other core and effect type bulked yarns could also be used herein.

Furthermore, the knitted structure has been shown and described as having the elastic yarn inlaid with the courses and wales of an absorbent yarn. Since the elasticity and the contractive holding power of the elastic dampening roll covers are most desirable in a direction around the circumference of the sleeve, this is the preferred embodiment herein, although not the only embodiment.

The above-described specific embodiments of this invention have been set forth for the purposes of illustration. It will be apparent to those skilled in the art that various modifications may be made in the composition of the dampening roll cover without departing from the principles of this invention as pointed out and disclosed herein. For that reason, it is not intended that the invention should be limited other than by the scope of the appended claims.

What is claimed is:

1. An elastic dampening roll cover knitted in the form of a tubular sleeve comprising:

knitted courses and wales of inelastic absorbent yarn, said inelastic absorbent yarn comprising a substantially inelastic bulked yarn having a plurality of substantially continuous filaments which are individually convoluted into coils, crunodal loops and whorls at random intervals along their length and having a multiplicity of crunodal loops irregularly spaced along the yarn surface; said inelastic absorbent yarn is an air-bulked filament, core and effect yarn comprising nylon and rayon; and, an elastic yarn interlaced with said courses and wales around the circumference of said tubular sleeve, said elastic yarn comprising an elastic core strand and an absorbent wrapping strand associated with said core strand in the form of doubled-back loops wound with false twist for a multiplicity of turns around the circumference of said elastic core strand.

* * * * *